US010362641B2

(12) United States Patent
Omori et al.

(10) Patent No.: US 10,362,641 B2
(45) Date of Patent: Jul. 23, 2019

(54) MICROWAVE TREATMENT APPARATUS

(71) Applicant: Panasonic Intellectual Property Management Co., Ltd., Osaka (JP)

(72) Inventors: Yoshiharu Omori, Shiga (JP); Koji Yoshino, Shiga (JP); Masaharu Tsujimoto, Shiga (JP); Takahide Yamaguchi, Shiga (JP); Junji Hirata, Shiga (JP); Takayuki Akashi, Nara (JP); Masafumi Sadahira, Shiga (JP); Masayuki Kubo, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 50 days.

(21) Appl. No.: 15/117,688

(22) PCT Filed: Mar. 11, 2015

(86) PCT No.: PCT/JP2015/001325

§ 371 (c)(1),
(2) Date: Aug. 9, 2016

(87) PCT Pub. No.: WO2015/146028

PCT Pub. Date: Oct. 1, 2015

(65) Prior Publication Data

US 2016/0353529 A1 Dec. 1, 2016

(30) Foreign Application Priority Data

Mar. 25, 2014 (JP) ..... 2014-061329
Jan. 23, 2015 (JP) ..... 2015-011260

(51) Int. Cl.
*H05B 6/70* (2006.01)
*H05B 6/64* (2006.01)

(52) U.S. Cl.
CPC ..... *H05B 6/708* (2013.01); *H05B 6/6411* (2013.01); *H05B 6/704* (2013.01)

(58) Field of Classification Search
CPC .. H05B 6/6402; H05B 6/6411; H05B 6/6455; H05B 6/6464; H05B 6/66; H05B 6/70;
(Continued)

(56) References Cited

U.S. PATENT DOCUMENTS 4,301,347 A 11/1981 Quine
4,916,458 A 4/1990 Goto
(Continued)

FOREIGN PATENT DOCUMENTS

CN 1740645 A 3/2006
CN 103229593 A 7/2013
(Continued)

OTHER PUBLICATIONS

International Search Report of PCT application No. PCT/JP2015/001325 dated Jun. 16, 2015.
(Continued)

*Primary Examiner* — Hung D Nguyen
(74) *Attorney, Agent, or Firm* — Brinks Gilson & Lione

(57) ABSTRACT

A microwave oven includes a waveguide having an E-bend structure with multiple openings disposed on a lateral face of a heating chamber that allow the waveguide to communicate with the heating chamber. The waveguide has a first section for propagating a microwave from a magnetron toward the heating chamber, and a second section having a wide plane that abuts an outer wall of the heating chamber. The openings include at least one circularly-polarized-wave opening for generating a circularly polarized wave. A cross section of the first section orthogonally intersects a tube axis of the first section projects virtually along the tube axis of first section and onto a lateral face of the heating chamber, and the
(Continued)

circularly-polarized-wave opening is configured such that its center is located outside the resultant projected region.

10 Claims, 15 Drawing Sheets

(58) Field of Classification Search
CPC ..... H05B 6/704; H05B 6/705; H05B 6/707; H05B 6/708; H05B 6/72; H05B 6/725; H05B 6/74; H05B 6/80
USPC ..... 219/690, 691, 692, 693–697, 746–754, 219/756
See application file for complete search history.

(56) References Cited

U.S. PATENT DOCUMENTS 5,579,019 A 11/1996 Uematsu et al.
5,698,036 A 12/1997 Ishii et al.
5,948,310 A 9/1999 Shon et al.
6,066,841 A * 5/2000 Kim ..... H05B 6/6402 219/746
6,097,018 A 8/2000 Kim et al.
6,720,541 B2 * 4/2004 Watanabe ..... H05B 6/6411 219/754
2015/0173128 A1 * 6/2015 Hosokawa ..... H05B 6/70 219/756

FOREIGN PATENT DOCUMENTS

JP 7-106847 4/1995
JP 9-181052 7/1997
JP 2733472 B 3/1998
JP 2000-048946 2/2000
JP 3510523 B 3/2004
JP 2013-125670 6/2013
JP 2648479 A1 * 10/2013 ..... H05B 6/704
WO 2012/073451 6/2012

OTHER PUBLICATIONS

English Translation of Chinese Search Report dated Jan. 2, 2019 for the related Chinese Patent Application No. 201580009480.0.

* cited by examiner

MICROWAVE TREATMENT APPARATUS

CROSS-REFERENCE TO RELATED APPLICATIONS

This application is a U.S. national stage application of the PCT International Application No. PCT/JP2015/001325 filed on Mar. 11, 2015, which claims the benefit of foreign priority of Japanese patent applications 2014-061329 filed on Mar. 25, 2014 and 2015-011260 filed on Jan. 23, 2015, the contents all of which are incorporated herein by reference.

TECHNICAL FIELD

The present disclosure relates to a microwave treatment apparatus (e.g. microwave oven) for heating a target object with a microwave.

BACKGROUND ART

A microwave treatment apparatus heats a target object (e.g. food) placed in a heating chamber with a microwave that is generated by a magnetron (i.e. a typical microwave generator) and then supplied to the heating chamber through a waveguide.

Nevertheless an electric field distribution generated in the heating chamber by the microwave supplied is not always uniform. A conventional apparatus uses a motor for rotating a turntable so that a target object can rotate within a heating chamber in order to be heated uniformly. Here is another conventional apparatus that employs a motor for rotating a rotary antenna, thereby agitating the microwave before the microwave is supplied into a heating chamber in order to heat a target object uniformly.

On the other hand, a method for uniformly heating a target object is proposed. This method uses a circularly polarized wave or an elliptically polarized wave, of which polarization plane rotates with the lapse of time. Generation of the circularly polarized wave or the elliptically polarized wave needs a pair of exciting means, of which exciting directions cross each other, for generating a pair of excitations where a phase difference is formed.

FIG. 12 shows an electric current running on a plane of a waveguide in the conventional microwave treatment apparatus. As FIG. 12 shows, rectangular waveguide 100, through which a microwave propagates in TE10 mode, has a cross section that intersects with the longer direction (i.e. the propagating direction of the microwave) at right angles. This cross section forms a rectangle. Wave guide 100 includes narrow plane 102 and wide plane 103.

In such waveguide 100, in the case of forming an opening in cross section 101 vertical to the propagating direction of the microwave, electric field 104 is generated along the same direction within waveguide 100, so that excitation in uniaxial direction is generated. In the case of forming the opening in narrow plane 102, electric current 105 flows along the same direction in narrow plane 102, so that excitation in a uniaxial direction is generated.

Nevertheless, in the case of forming the opening in wide plane 103, electric current 105 flows in various directions depending on a place in wide plane 103, so that excitation in biaxial directions is generated.

Based on the foregoing reason, the opening should be formed in wide plane 103 in order to generate a circularly polarized wave, which is generated by a pair of exciting means of which exciting directions cross each other.

Propagation of the microwave causes an exciting position to move with a lapse of time, so that, for instance, two openings are formed in combination with each other for generating the circularly polarized wave.

FIG. 13A and FIG. 13B schematically illustrate changes in status of generating the circularly polarized wave at opening 107. Opening 107 is shaped like a cross-slot (i.e. two rectangular slots cross each other at right angles) for generating the circularly polarized wave.

FIG. 13A and FIG. 13B show propagating direction 109 of the microwave and a rotating direction of the circularly polarized wave generated at opening 107. FIG. 13A shows the propagating direction of the microwave from the top of the paper toward the bottom of the paper, and, contrary to FIG. 13A, FIG. 13B shows the propagating direction of the microwave from the bottom of the paper toward the top of the paper.

In FIG. 13A, propagating direction 109 in waveguide 100 is directed downward of the paper. Magnetic field 108 generated by the microwave moves downward with a lapse of time.

As FIG. 13A shows, at time to, magnetic field 108 excites a first rectangular slot of opening 107 in exciting direction 110*a*. At time t1, namely, after a lapse of a given time, magnetic field 108 moves downward, and a second slot of opening 107 is excited in exciting direction 110*b*. At time t2 and time t3, exciting directions 110*c* and 110*d* are changed in turn as illustrated in FIG. 13A, so that the circularly polarized wave that rotates anti-clockwise is generated.

As FIG. 13B shows, propagating direction 109 within waveguide 100 is directed upward on the paper. Magnetic field 108 generated by the microwave moves upward on the paper with a lapse of time. A time lapse from time TO to time t3 causes exciting directions 110*a*, 110*b*, 110*c*, and 110*d* at opening 107 to change as shown in FIG. 13B, so that the circularly polarized wave that rotates clockwise, which is reversal to what is shown in FIG. 13A, is generated. As discussed above, the circularly polarized wave or the wave rotating in a reversal direction is generated in response to propagating direction 109 within waveguide 100.

FIG. 14 is a schematic plan view of a waveguide, which generates a circularly polarized wave, of a conventional microwave treatment apparatus disclosed in patent literature 1. FIG. 15 is a schematic perspective view of a waveguide, which generates a circularly polarized wave, of another conventional microwave treatment apparatus disclosed in patent literature 2

As FIG. 14 shows, patent literature 1 discloses a structure in which opening 107 is disposed on waveguide 106*a*. This opening is formed of two rectangular slots crossing each other vertically. As FIG. 15 shows, patent literature 2 discloses a structure in which openings 107*a* and 107*b* are disposed in a wide plane of waveguide 106*b*. These openings 107*a* and 107*b* do not cross each other, but disposed vertically to each other.

CITATION LIST

Patent Literature 1: U.S. Pat. No. 4,301,347
Patent Literature 2: Examined Japanese Patent Publication No. 3510523

SUMMARY OF INVENTION

The prior art disclosed in patent literatures 1 and 2 need to make waveguides 106*a* and 106*b* longer in order to avoid adverse influences such as disturbance in electromagnetic filed distribution around a magnetron.

Reflected waves generated at the ends of waveguides 106*a* and 106*b* allow generating circularly polarized waves rotating in a reversal direction, so that the rotation in an exciting direction can be cancelled, or a generation of standing waves in waveguides 106*a* and 106*b* lowers a radiation efficiency from the opening.

As FIG. 14 shows, the conventional art disclosed in patent literature 1 includes phase shifter 111 (i.e. rotating body) at the end of waveguide 106*a* in order to change a phase of the reflected wave. Nevertheless, this prior art is silent about an advantage of reducing the reflected wave, but it describes that waveguide 106*a* is obliged to be substantially longer.

The present disclosure addresses the foregoing problems, and aims to provide a microwave treatment apparatus capable of generating efficiently a circularly polarized wave or an elliptically polarized wave by using a compact waveguide.

To solve the foregoing problems, the microwave treatment apparatus in accordance with one aspect of the present disclosure includes a heating chamber for accommodating a target object, a microwave generator, and a waveguide.

The waveguide has an E-bend structure, a first section for propagating a microwave from the microwave generator toward the heating chamber, and a second section of which wide plane abuts on the outer wall of the heating chamber. The heating chamber has a lateral face provided with multiple openings. The openings allow the heating chamber to communicate with the waveguide. The multiple openings include at least one circularly-polarized-wave opening for generating a circularly polarized wave.

A cross section of the first section orthogonally intersecting a tube axis of the first section is projected virtually, along the tube axis of the first section, onto a lateral face of the heating chamber, and the circularly-polarized-wave opening is formed such that its center is not located in the resultant projected region defined by this projection.

The foregoing structure of this aspect allows reducing adverse effects (e.g. disturbance in the electromagnetic field distribution around the magnetron). As a result, use of the compact size waveguide allows generating a circularly polarized wave or an elliptically polarized wave more positively.

DESCRIPTION OF EMBODIMENTS

Figure 1:
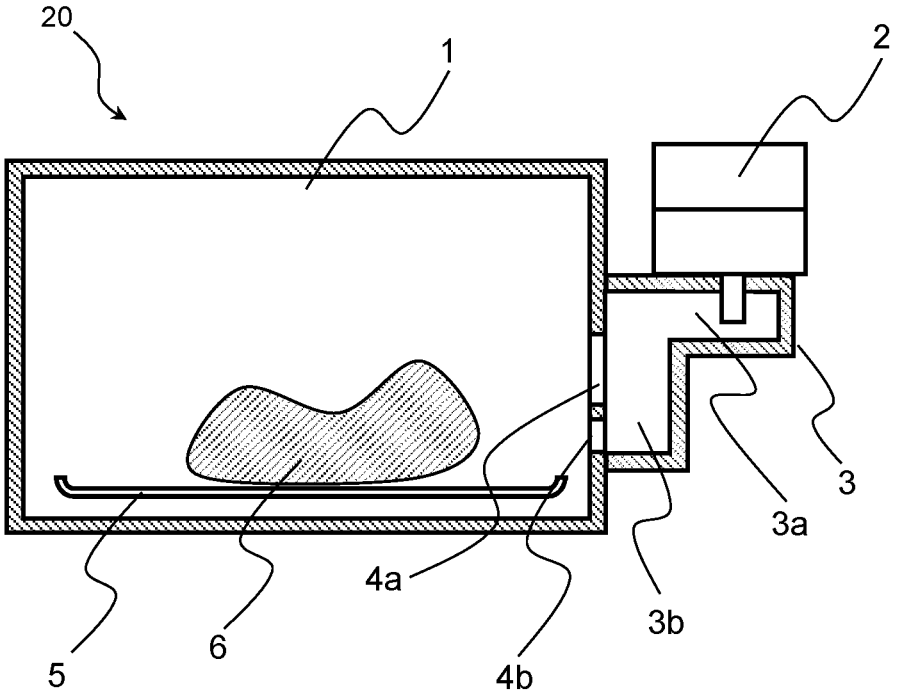
FIG. 1 is a sectional view of a microwave treatment apparatus in accordance with a first embodiment of the present disclosure.

A microwave treatment apparatus in accordance with a first aspect of the present disclosure includes a heating chamber for accommodating a target object, a microwave generator, and a waveguide.

The waveguide has an E-bend structure, a first section for propagating a microwave from the microwave generator toward the heating chamber, and a second section of which wide plane abuts on the outer wall of the heating chamber. The heating chamber has a lateral face provided with multiple openings. The openings allow the heating chamber to communicate with the waveguide. The multiple openings include at least one circularly-polarized-wave opening for generating a circularly polarized wave.

A cross section of the first section orthogonally intersecting a tube axis of the first section is projected virtually, along the tube axis of the first section, onto a lateral face of the heating chamber, and the circularly-polarized-wave opening is formed such that its center is not located in the resultant projected region defined by this projection.

A microwave treatment apparatus in accordance with a second aspect of the present disclosure includes a reflected-wave-suppression opening in addition to the structural elements of the microwave treatment apparatus in accordance with the first aspect. The reflected-wave-suppression opening is disposed closer to the end of the waveguide than the circularly-polarized-wave opening, and has a length equal to or greater than a half of the wavelength of the microwave. According to this second aspect, a compact size waveguide that allows reducing reflected waves generated at the end of the waveguide can be formed.

A microwave treatment apparatus in accordance with a third aspect of the present disclosure includes a table at a lower section of the heating chamber and a driver for rotating the table in addition to the structural elements of the apparatus in accordance with the second aspect. The reflected-wave-suppression opening is located at the lower section of the heating chamber.

According to the third aspect, a rotation of the target object allows changing an amount and a phase of the reflected wave traveling from the heating chamber into the waveguide. In response to these changes, an amplitude and a position of the standing wave generated in the waveguide change. As a result, the target object can be heated more uniformly.

A microwave treatment apparatus in accordance with a fourth aspect of the present disclosure includes a structure of the circularly-polarized-wave opening where two slot-openings are combined. This structure differs from that of the first aspect. According to this fourth aspect, excitations in two directions are generated, thereby generating the circularly polarized wave more positively.

A microwave treatment apparatus in accordance with a fifth aspect of the present disclosure includes a structure in which the circularly-polarized-wave opening is formed such that the center of the circularly-polarized-wave opening deviates from a tube axis of the second section. This structure differs from that of the first aspect. According to the fifth aspect, the waveguide is excited at the edge of the magnetic field propagating, thereby generating the circularly polarized wave more positively.

A microwave treatment apparatus in accordance with a sixth aspect of the present disclosure includes a structure in which the circularly-polarized-wave opening shapes like a regular polygon or a circle. This structure differs from that of the first aspect. According to the sixth aspect, the waveguide is excited at the edge of the magnetic field propagating, thereby exciting the microwave, supplied into the heating chamber, in two directions uniformly. As a result, the circularly polarized wave can be generated more positively.

A microwave treatment apparatus in accordance with a seventh aspect of the present disclosure includes a structure in which the circularly-polarized-wave opening shapes like a polygon, and this polygonal opening has multiple and longest diagonal lines. This structure differs from that of the first aspect. According to the seventh aspect, this structure allows generating more positively the excitations in two directions different from each other, whereby the circularly polarized wave can be generated more positively.

A microwave treatment apparatus in accordance with an eighth aspect of the present disclosure includes a structure in which the slot opening has a longer direction length different from a shorter direction length, and also includes rounded corners. The circularly-polarized-wave opening has multiple and longest inner diameters. These structures differ from those in the fourth aspect. According to this eighth aspect, directions of excitations generated at each slot can be stabilized, thereby stabilizing the excitations in two directions different from each other. As a result, the circularly polarized wave can be generated more positively.

A microwave treatment apparatus in accordance with a ninth aspect of the present disclosure includes a structure in which the circularly-polarized-wave opening includes the slot-openings crossing each other at an angle other than 90 degrees. This is a different point from the structure of the fourth aspect. According to the ninth aspect, a directivity of the circularly polarized wave generated can be polarized in a desirable direction.

A microwave treatment apparatus in accordance with a tenth aspect of the present disclosure includes a structure in which a first slot opening intersects with the tube axis of the waveguide at a first angle, and a second slot opening intersects with the tube axis of the waveguide at a second angle different from the first angle. This is a different point from the structure of the fourth aspect. According to the tenth aspect, a directivity of the circularly polarized wave generated can be polarized in a desirable direction.

Preferred embodiments of the microwave treatment apparatuses in accordance with the present disclosure are demonstrated hereinafter with reference to the accompanying drawings. In the embodiments below, instances of the microwave oven are described; however, the microwave treatment apparatus of the present disclosure is not limited to the microwave oven, but the apparatus includes a processing apparatus, garbage processor, or semiconductor manufacturing device using the heat by microwave.

In the following drawings, structural elements similar to each other have the same reference marks, and the descriptions thereof are sometimes omitted.

First Exemplary Embodiment

Figure 2:
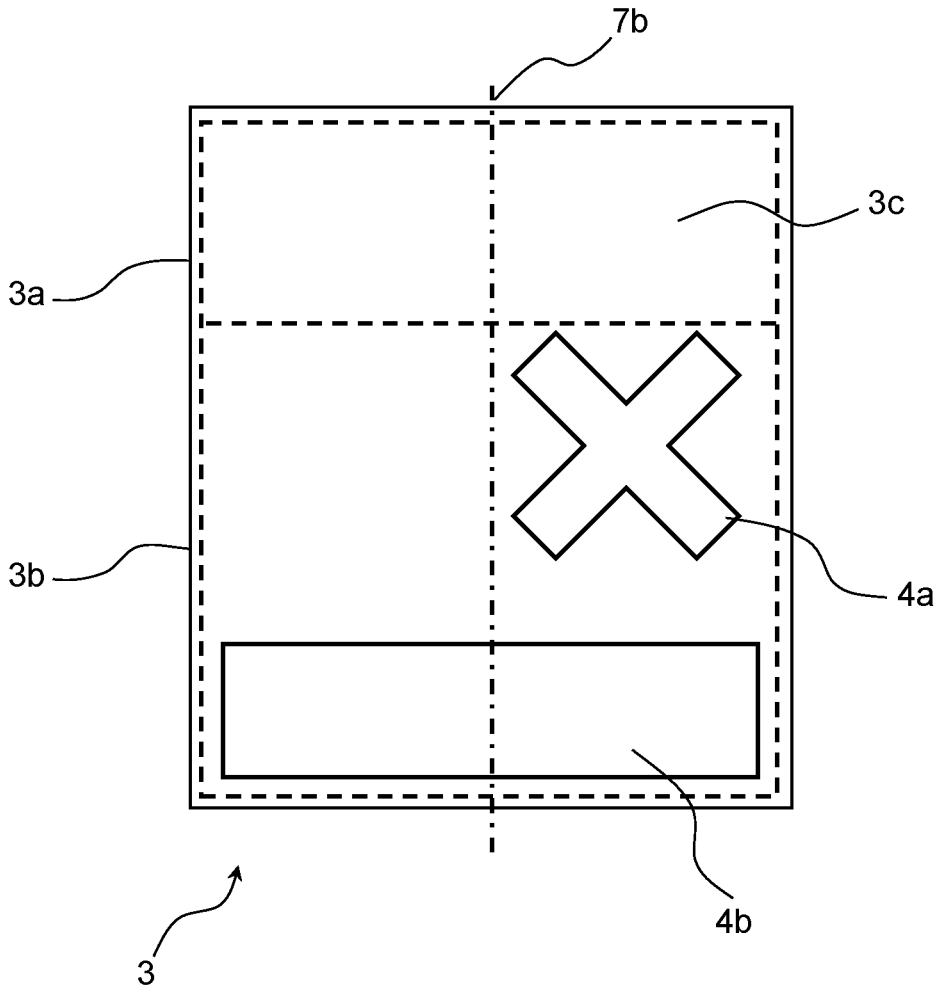
FIG. 2 shows schematically an opening, which allows a heating chamber to communicate with a waveguide of the microwave treatment apparatus in accordance with the first embodiment.
Figure 3:
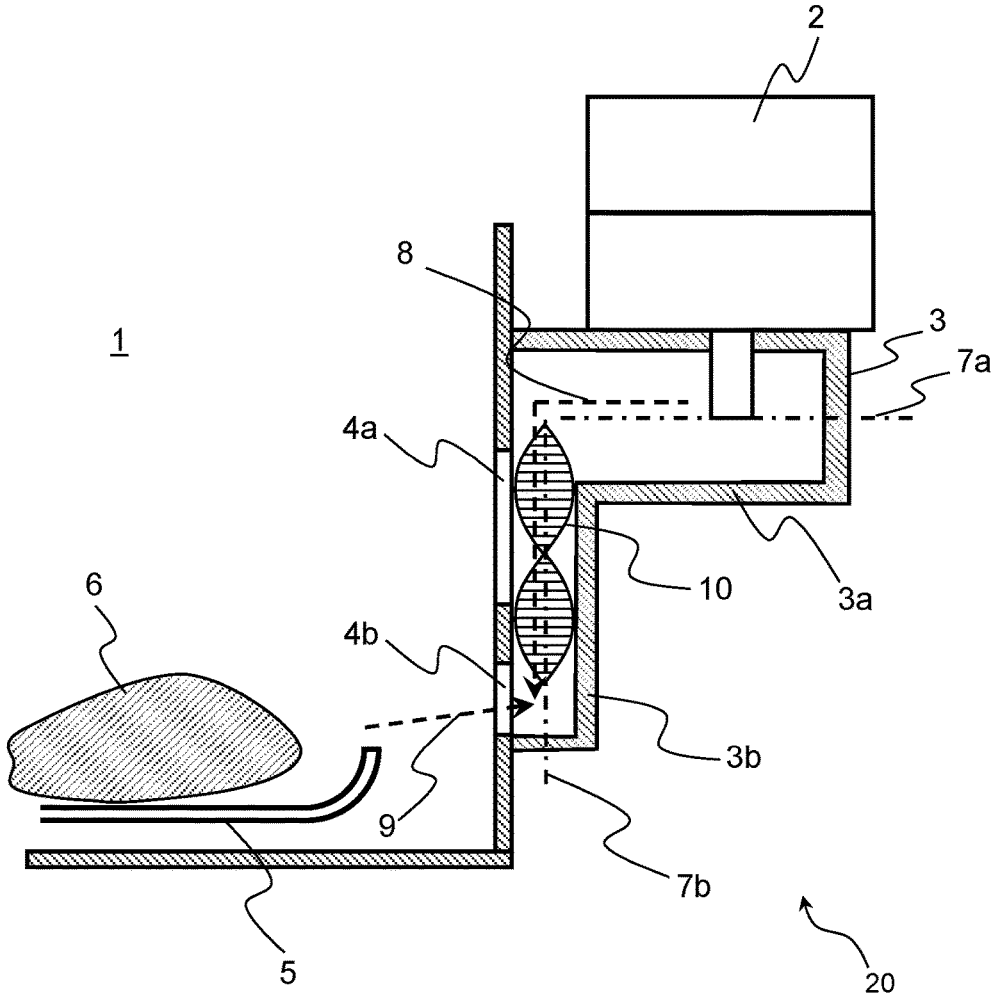
FIG. 3 is an enlarged sectional view of the microwave treatment apparatus in accordance with the first embodiment.

FIG. 1 is a schematic sectional view of microwave oven 20, namely, the microwave treatment apparatus in accordance with the first embodiment. FIG. 1 specifically shows structures of waveguide 3 and heating chamber 1. FIG. 2 shows an opening that allows heating chamber 1 to communicate with waveguide 3. This FIG. 2 is viewed from the inside of heating chamber 1. FIG. 3 is an enlarged sectional view of waveguide 3 and its vicinity.

As FIG. 1-FIG. 3 show, microwave oven 20, which is an example of the microwave treatment apparatus in accordance with the first embodiment, includes target object 6 placed on table 5 disposed in heating chamber 1. Magnetron 2 works as a microwave generator. Waveguide 3 is mounted to a lateral face of heating chamber 1 viewed from the front of chamber 1.

The microwave generated by magnetron 2 propagates through waveguide 3 and arrives at circularly-polarized-wave opening 4*a* disposed between heating chamber 1 and waveguide 3. When the microwave travels through opening 4*a*, the circularly polarized wave is generated at opening 4*a*. The microwave changed into the circularly polarized wave is supplied to target object 6 accommodated in heating chamber 1.

Reflected-wave-suppression opening 4*b* is formed closer to a lower end of waveguide 3 than opening 4*a* (in this embodiment, it is located below opening 4*a*), and allows waveguide 3 to communicate with heating chamber 1. Opening 4*b* shapes like a rectangle of which longer side is equal to or greater in length than a half of the wavelength of the microwave traveling through waveguide 3.

Waveguide 3 is a square waveguide and has a cross section that shapes like a rectangle and orthogonally intersects with the propagating direction of the microwave. This square waveguide 3 includes a pair of surfaces each having a greater width and referred to as a wide plane, and another pair of surfaces each having a smaller width and referred to as a narrow plane.

Waveguide 3 includes a first section and a second section in which the narrow plane is bent like a letter L and intersecting with each other substantially at right angles. This structure is generally referred to as an E-bend structure.

The first section extends substantially vertically to the lateral faces of heating chamber 1, and propagates the microwave toward heating chamber 1 (in FIG. 1 and FIG. 3, toward the left). The second section extends along the lateral faces of heating chamber 1 and propagates the microwave in parallel with the lateral faces of heating chamber 1 (in FIG. 1 and FIG. 3, toward the downward direction). The first section is referred to as vertical section 3*a*, and the second section is referred to as parallel section 3*b* hereinafter.

Waveguide 3 abuts on heating chamber 1 at the wide plane of parallel section 3*b*, and is located such that the lower end thereof is situated as high as table 5 in heating chamber 1.

The structure discussed above allows waveguide 3 to be accommodated within a space necessary for placing magnetron 2.

A propagation distance of the microwave in waveguide 3 is a total length of a length of vertical section 3*a* along the tube axis of waveguide 3 and a length of parallel section 3*b*. Heating chamber 1 of a low height thus can keep a sufficient propagation distance, which prevents the disturbance in the electromagnetic field generated around magnetron 2 from adversely influencing the vicinities of circularly-polarized-wave opening 4*a* and reflected-wave-suppression opening 4*b*.

As FIG. 2 shows, circularly-polarized-wave opening 4*a* forms a shape of a cross slot that shapes like a letter X in which two rectangular slots intersect orthogonally with each other. These two rectangular slots have the same dimensions and the same shape.

Circularly-polarized-wave opening 4*a* is formed in the following manner: A cross section of vertical section 3*a* orthogonally intersecting with tube axis 7*a* (refer to FIG. 3) of vertical section 3*a* is virtually projected along tube axis 7*a* onto a lateral face of heating chamber 1. The resultant region defined by this projection and formed on the lateral face of heating chamber 1 is hereinafter referred to as cross-section projected region 3*c*. Circularly-polarized-wave opening 4*a* is formed such that the center of opening 4*a* should be located outside this region 3*c*.

On top of that, circularly-polarized-wave opening 4*a* is formed such that the center of opening 4*a* should be located outside tube axis 7*b* of parallel section 3*b* shown in FIG. 2. Tube axis 7*b*, to be more specific, is a straight line projected on the wide plane of parallel section 3*b*, and yet, is a center line of a shorter side of parallel section 3*b* of wave guide 3.

The foregoing location of circularly-polarized-wave opening 4*a* allows generating an excitation at the edge of the electromagnetic field having less disturbances, and this excitation has a time lag in two directions. As a result, the structure discussed above allows generating a circularly polarized wave or an elliptically polarized wave more positively.

Almost all the microwave propagating to the end of waveguide 3 is supplied, through reflected-wave suppression opening 4*b*, into heating chamber 1 as linearly polarized microwave. Since opening 4*b* can suppress the reflection of the microwave at the end of waveguide 3, the circularly polarized wave or the elliptically polarized wave can be generated more positively at opening 4*a*.

Target object 6 is placed on table 5 to be rotated by a motor (driver, not shown), so that it can rotate in heating chamber 1. The rotation of target object 6 causes a distance between target object 6 and reflected-wave-suppression opening 4*b* to vary every moment, where opening 4*b* is formed at a lower section of the lateral face of heating chamber 1. The variation in the distance causes changes every moment in an amount and a phase of the microwave (reflected wave 9 shown in FIG. 3) that reflects from the inside of heating chamber 1 toward opening 4*b*.

In waveguide 3, the microwave (traveling wave 9 shown in FIG. 3) traveling from magnetron 2 toward heating chamber 1 is superposed over reflected wave 9 that returns to waveguide 3 via opening 4*b*, thereby generating standing wave 10. Since the amount and the phase of reflected wave 9 vary every moment as discussed above, a state of standing wave 10 also varies every moment.

As discussed above, rotational excitations in two directions are superposed together with the aid of traveling wave 8 and reflected wave 9, so that a complex electromagnetic field distribution that varies from the circularly polarized wave to the elliptically polarized wave (close to a linearly polarized wave) and vice versa can be generated. Use of this complex electromagnetic field distribution in heating the target object 6 with the microwave allows reducing unevenness in heating.

In this embodiment, circularly-polarized-wave opening 4*a* shaped like a letter X is described; however, the shape thereof is not limited to this one. As long as opening 4*a* includes two rectangular slots orthogonally intersecting with each other, it functions well. For instance, opening 4*a* can be shaped like a letter L or a letter T. Opening 4*a* also can be shaped like this as disclosed in patent literature 2: two rectangular slots orthogonally intersecting with each other are spaced away at an interval.

Second Exemplary Embodiment

FIG. 4A-FIG. 4D show examples of the opening that allows waveguide 3 to communicate with heating chamber 1 of microwave oven 20 in accordance with the second embodiment of the present disclosure.

Figure 4A:
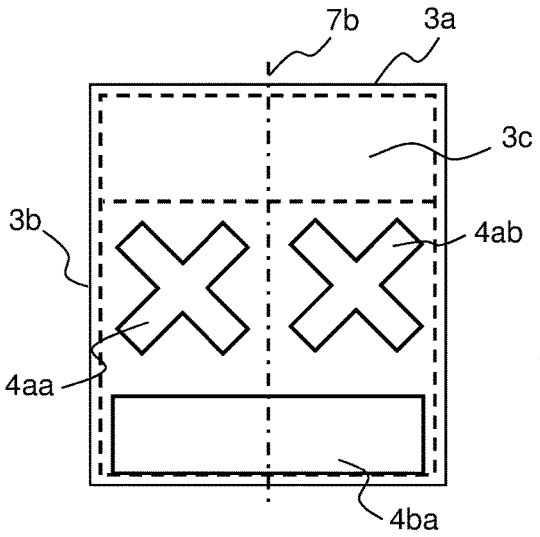
FIG. 4A shows an example of an opening that allows a waveguide to communicate with a heating chamber in accordance with a second embodiment of the present disclosure.

As FIG. 4A shows, circularly-polarized-wave openings 4*aa*, 4*ab*, and reflected-wave-suppression opening 4*ba* are formed on a wide plane of parallel section 3*b*. Openings 4*aa* and 4*ab* have the same shape and the same dimensions as opening 4*a* used in the first embodiment. These two openings 4*aa* and 4*ab* are disposed in a lateral direction.

Reflected-wave-suppression opening 4*ba* is substantially the same as opening 4*b* used in the first embodiment, and obtains an advantage similar to that of opening 4*b*.

Figure 4B:
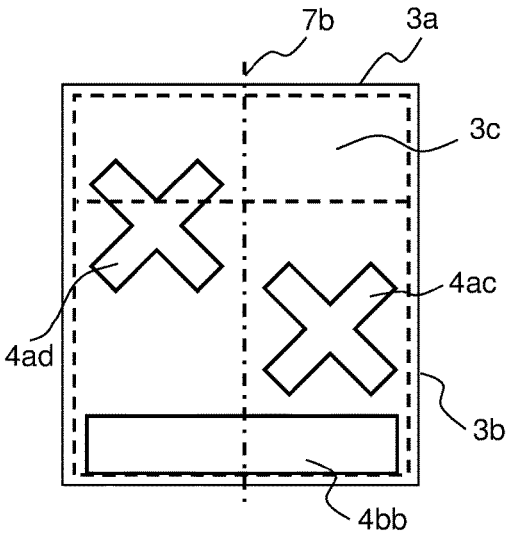
FIG. 4B shows an example of an opening in accordance with the second embodiment.

As FIG. 4B shows, circularly-polarized-wave openings 4*ac*, 4*ad*, and reflected-wave-suppression opening 4*bb* are formed on the wide plane of parallel section 3*b*. Openings 4*ac* and 4*ad* have the same shape and the same dimensions as opening 4*a*, and these two openings 4*ac*, 4*ad* are disposed along a phantom slanting line on the wide plane of parallel section 3*b*.

Reflected-wave-suppression opening 4*bb* has a width narrower than that of opening 4*b*; however, opening 4*bb* can obtain an advantage similar to that of opening 4*b*.

Figure 4C:
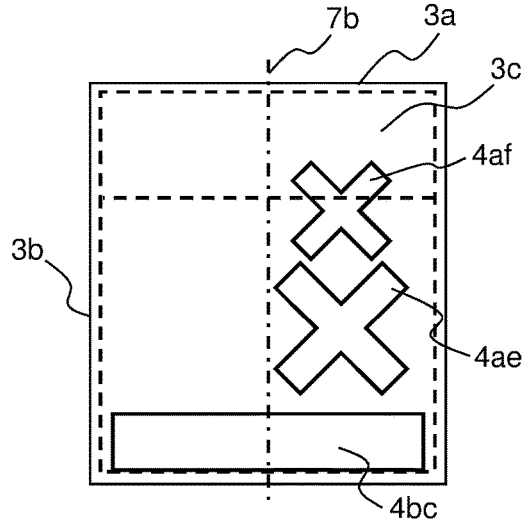
FIG. 4C shows an example of an opening in accordance with the second embodiment.

As FIG. 4C shows, circularly-polarized-wave openings 4*ae*, 4*af*, and reflected-wave-suppression opening 4*bc* are formed on the wide plane of parallel section 3*b*. Openings 4*ae* and 4*af* have the same shape and the same dimensions as opening 4*a*, and opening 4*af* has a shape similar to opening 4*a* but smaller than opening 4*a*. Openings 4*ae*, 4*af* are disposed along a phantom vertical line on the wide plane at the right-half of parallel section 3*b*.

Reflected-wave-suppression opening 4*bc* has a width narrower than that of opening 4*b*; however, it can obtain an advantage similar to opening 4*b*.

Figure 4D:
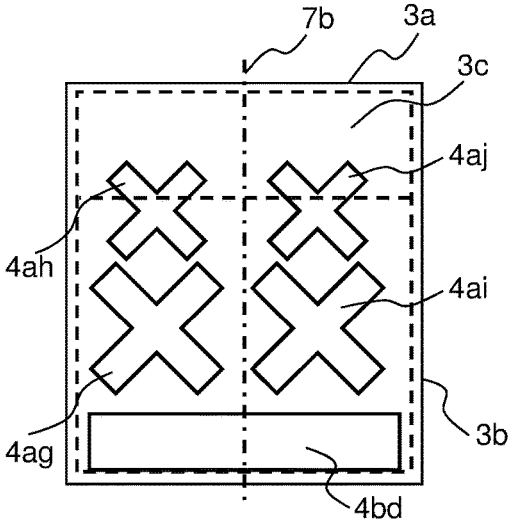
FIG. 4D shows an example of an opening in accordance with the second embodiment.

As FIG. 4D shows, circularly-polarized-wave openings 4*ag*, 4*ah*, 4*ai*, 4*aj*, and reflected-wave-suppression opening 4*bd* are formed on the wide plane of parallel section 3*b*. Openings 4*ag* and 4*ah* have the same shape and the same dimensions as openings 4*ae* and 4*af* shown in FIG. 4C respectively, and these two openings 4*ag* and 4*ah* are disposed on the wide plane at the right-half of parallel section 3*b*. Openings 4*ai* and 4*aj* have the same shape and the same dimensions as openings 4*ag* and 4*ah* respectively, and they are disposed on the wide plane at the left-half of parallel section 3*b*.

Reflected-wave-suppression opening 4*bd* has a width narrower than opening 4*b*; however, opening 4*bd* can obtain an advantage similar to opening 4*b*.

As FIG. 4A-FIG. 4D show, circularly-polarized-wave openings 4*aa*-4*aj* are formed such that each center of openings 4*aa*-4*aj* is located outside the projected cross section region 3*c* and tube axis 7*b*. This structure is similar to that of opening 4*a* in accordance with the first embodiment.

The structures discussed above allow generating excitations at the edge of the electromagnetic field having less disturbance. This excitation has a time lag in two directions. As a result, the circularly polarized wave or the elliptically polarized wave can be generated more positively.

Third Exemplary Embodiment

Figure 5A:
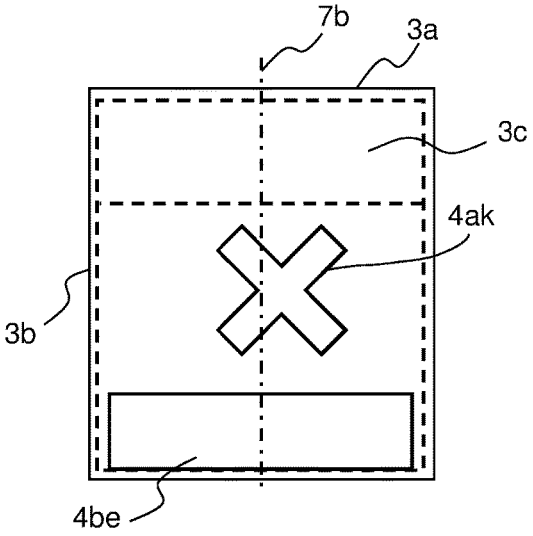
FIG. 5A shows an example of an opening that allows a waveguide to communicate with a heating chamber in accordance with a third embodiment of the present disclosure.
Figure 5B:
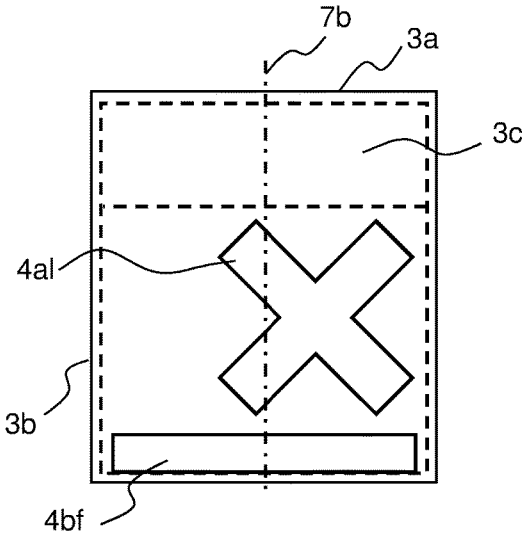
FIG. 5B shows an example of an opening in accordance with the third embodiment.
Figure 5C:
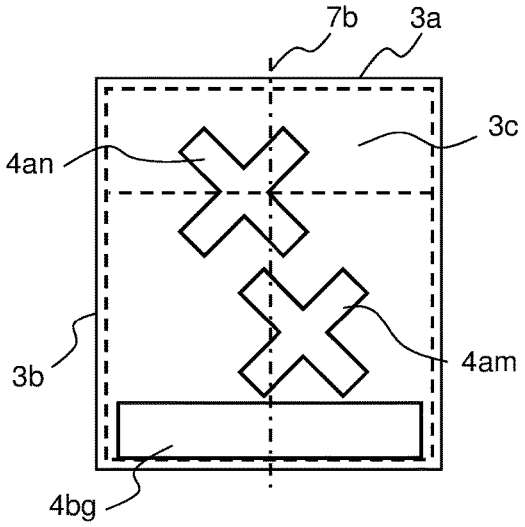
FIG. 5C shows an example of an opening in accordance with the third embodiment.

FIG. 5A-FIG. 5C show examples of openings that allow waveguide 3 to communicate with heating chamber 1 of microwave oven 20 in accordance with the third embodiment.

As FIG. 5A shows, circularly-polarized-wave opening 4*ak* and reflected-wave-suppression opening 4*be* are formed on the wide plane of parallel section 3*b* of waveguide 3. Opening 4*ak* has the same shape and the same dimensions as circularly-polarized-wave opening 4*a* in accordance with the first embodiment.

Reflected-wave-suppression opening 4*be* is substantially the same as opening 4*b* in accordance with the first embodiment, and obtains an advantage similar to that of the first embodiment.

As FIG. 5B shows, circularly-polarized-wave opening 4*a*1 and reflected-wave-suppression opening 4*bf* are formed on the wide plane of parallel section 3*b* of waveguide 3. Opening 4*a*1 has a shape similar to opening 4*a* but its dimensions are greater than opening 4*a*.

Reflected-wave-suppression opening 4*bf* is smaller than opening 4*b*, but can obtain an advantage similar to that of opening 4*b*.

As FIG. 5C shows, circularly-polarized-wave openings 4*am*, 4*an*, and reflected-wave-suppression opening 4*bg* are formed on the wide plane of parallel section 3*b*. This structure is similar to that shown in FIG. 4B, where circularly-polarized-wave openings 4*ac*, 4*ad*, and reflected-wave-suppression opening 4*bb* are formed. Openings 4*am* and 4*an* are disposed closer to tube axis 7*b* of parallel section 3*b* than openings 4*ac* and 4*ad* shown in FIG. 4B.

As FIG. 5A-FIG. 5C show, circularly-polarized-wave openings 4*ak*, 4*al*, 4*am*, and 4*n* are placed such that each center of these openings is located outside the projected cross section region 3*c* and tube axis 7*b*. This structure is similar to that of opening 4*a* in accordance with the first embodiment.

The structures discussed above allow generating excitations at the edge of the electromagnetic field having less disturbance. This excitation has a time lag in two directions. As a result, the circularly polarized wave or the elliptically polarized wave can be generated more positively.

Fourth Exemplary Embodiment

FIG. 6A-FIG. 6I show examples of openings that allow waveguide 3 to communicate with heating chamber 1 of microwave oven 20 in accordance with the fourth embodiment.

As FIG. 6A-FIG. 6F show, circularly-polarized-wave opening 4*ao* shapes like a cross-slot in which two rectangular slots intersect with each other.

Comparing with circularly-polarized-wave opening 4*a* used in the first embodiment, circularly-polarized-wave openings 4*ao* shown in FIG. 6A-FIG. 6F differ, for instance, in the size of rectangular slot, an intersecting angle of the two rectangular slots, and an intersecting position. Nevertheless each of openings 4*ao* can generate the excitation having a time lag in two directions as opening 4*a* can. As a result, the structures shown in FIG. 6A-FIG. 6F allow generating the circularly polarized wave or the elliptically polarized wave more positively.

The shape of opening 4*ao* is not limited to a letter X. As long as opening 4*ao* includes two rectangular slots orthogonally intersecting with each other, opening 4*ao* functions well. For instance, circularly-polarized-wave opening 4*ao* can be shaped like a letter L, or letter T, and as patent literature 2 discloses, opening 4*ao* can include two rectangular slots orthogonally intersecting with each other and spaced at an interval.

Figure 6A:
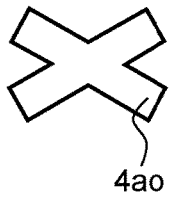
FIG. 6A shows an example of an opening that allows a waveguide to communicate with a heating chamber in accordance with a fourth embodiment of the present disclosure.
Figure 6B:
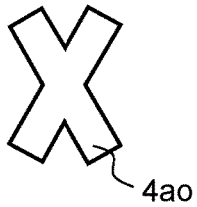
FIG. 6B shows an example of an opening in accordance with the fourth embodiment.
Figure 6C:
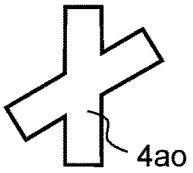
FIG. 6C shows an example of an opening in accordance with the fourth embodiment.
Figure 6D:
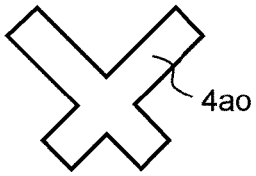
FIG. 6D shows an example of an opening in accordance with the fourth embodiment.
Figure 6E:
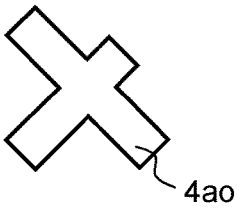
FIG. 6E shows an example of an opening in accordance with the fourth embodiment.
Figure 6F:
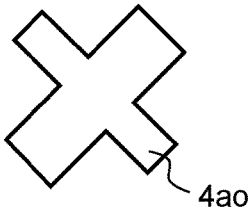
FIG. 6F shows an example of an opening in accordance with the fourth embodiment.
Figure 6G:
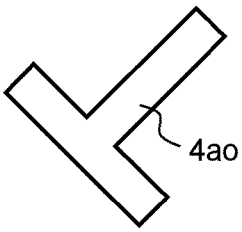
FIG. 6G shows an example of an opening in accordance with the fourth embodiment.
Figure 6H:
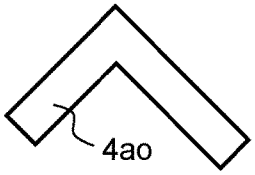
FIG. 6H shows an example of an opening in accordance with the fourth embodiment.
Figure 6I:
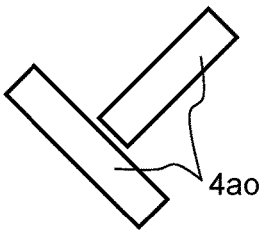
FIG. 6I shows an example of an opening in accordance with the fourth embodiment.

Circularly-polarized-wave opening 4*ao* shown in FIG. 6G-FIG. 6I is also structured by combining two rectangular slots; however, these two slots do not intersect with each other. This structure still can obtain an advantage similar to openings 4*ao* shown in FIG. 6-FIG. 6F.

A shape of the rectangular slot is not necessarily limited to a strict rectangle. For instance, the corners of rectangular slot can be elliptical. Here is another instance: a rectangular slot intersects with another rectangular slot having shorter and narrower dimensions at right angles, then an advantage similar to what is discussed previously can be obtained.

Each of the rectangular slots of circularly-polarized-wave opening 4*ao* is not necessarily limited to a strict rectangle. For instance, the corners of rectangular slot can be elliptical. This is a basic manner in which two rectangular slots intersect with each other at right angles, and one of the two slots has shorter and narrower dimensions than the other slot, and yet that one slot is placed such that its longer side confronts the narrow plane of waveguide 3. The structure following this basic manner can obtain an advantage similar to what is discussed previously.

Fifth Exemplary Embodiment

Figure 7:
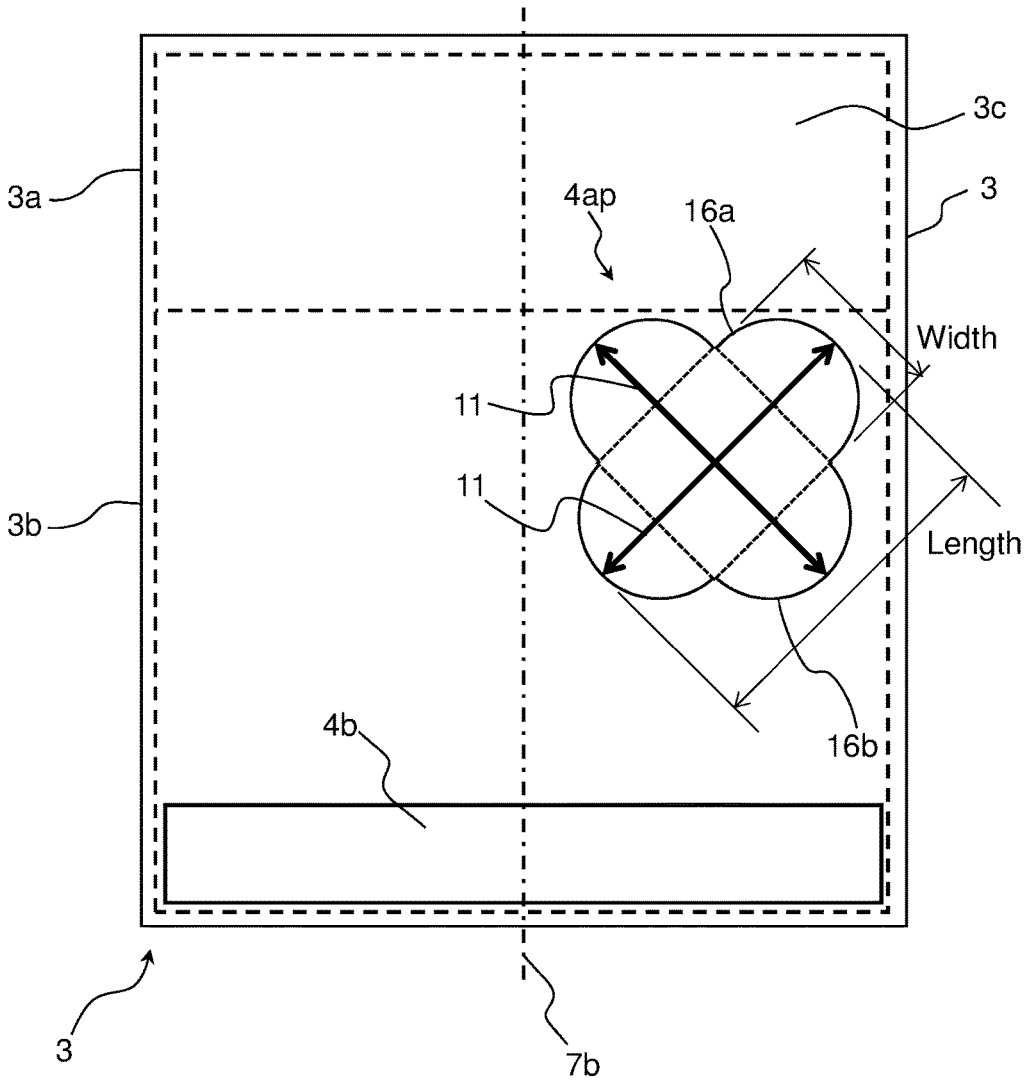
FIG. 7 shows an opening that allows a waveguide to communicate with a heating chamber in accordance with a fifth embodiment of the present disclosure.

FIG. 7 shows an opening that allows waveguide 3 to communicate with heating chamber 1 of microwave oven 20 in accordance with the fifth embodiment.

As FIG. 7 shows, circularly-polarized-wave opening 4*ap* is formed on the wade plane of waveguide 3. Opening 4*ap* shapes like a cross slot in which two slots 16*a* and 16*b* intersect orthogonally with each other. The longer sides (length shown in FIG. 7) of these two slots are longer than the shorter sides (width shown in FIG. 7) of these two slots.

Similar to the embodiments discussed previously, opening 4*ap* is placed such that its center is located outside the cross-section projected region 3*c*. On top of that, opening 4*ap* is placed such that its center is located outside tube axis 7*b* of parallel section 3*b* of waveguide 3.

An amount of electric power of the microwave radiated from slots 16*a* and 16*b* depends on the maximum inner diameter of opening 4*ap*. An exciting direction of the microwave depends on a direction of the maximum inner diameter.

As FIG. 7 shows, each end of slots 16*a*, 16*b* forms a circular arc, the maximum inner diameter 11 is slightly greater than the circularly-polarized-opening having a strictly rectangular slot by a roundness at both the ends. According to this fifth embodiment, the foregoing structure allows supplying, to heating chamber 1, the microwave having a greater amount of electric power than the circularly-polarized openings previously discussed.

The structure discussed above allows generating excitations at the edge of the electromagnetic field having less disturbance. This excitation has a time lag in two directions. As a result, the circularly polarized wave or the elliptically polarized wave can be generated more positively.

In this fifth embodiment, slots 16*a* and 16*b* having a circular arc shape at both ends are used. Each of slots 16*a* and 16*b* thus forms a track of an athletic field; however, a rectangular slot of which corner is slightly rounded can be used. In other words, each of the two slots has the maximum inner diameter in a longer direction at least at two places. This structure can produce an advantage similar to what is discussed previously.

Sixth Exemplary Embodiment

Figure 8A:
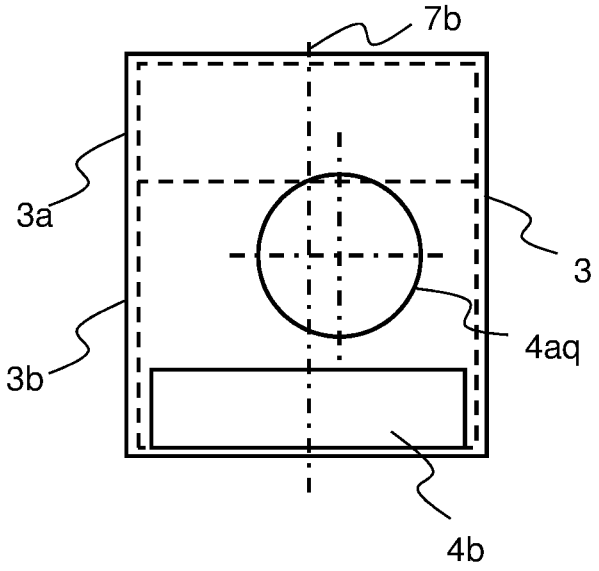
FIG. 8A shows an opening that allows a waveguide to communicate with a heating chamber in accordance with a sixth embodiment of the present disclosure.

FIG. 8A shows an example of an opening that allows waveguide 3 to communicate with heating chamber 1 of microwave oven 20 in accordance with the sixth embodiment. In this sixth embodiment, circularly-polarized-opening 4*aq* forms a circular opening.

As FIG. 8A shows, similar to the embodiments discussed previously, opening 4*aq* is placed such that its center is located outside the cross-section projected region 3*c*. On top of that, opening 4*aq* is placed such that its center is located outside tube axis 7*b*. Use of such single circular opening 4*aq* allows generating the excitations of microwave in multiple directions uniformly.

Figure 9:
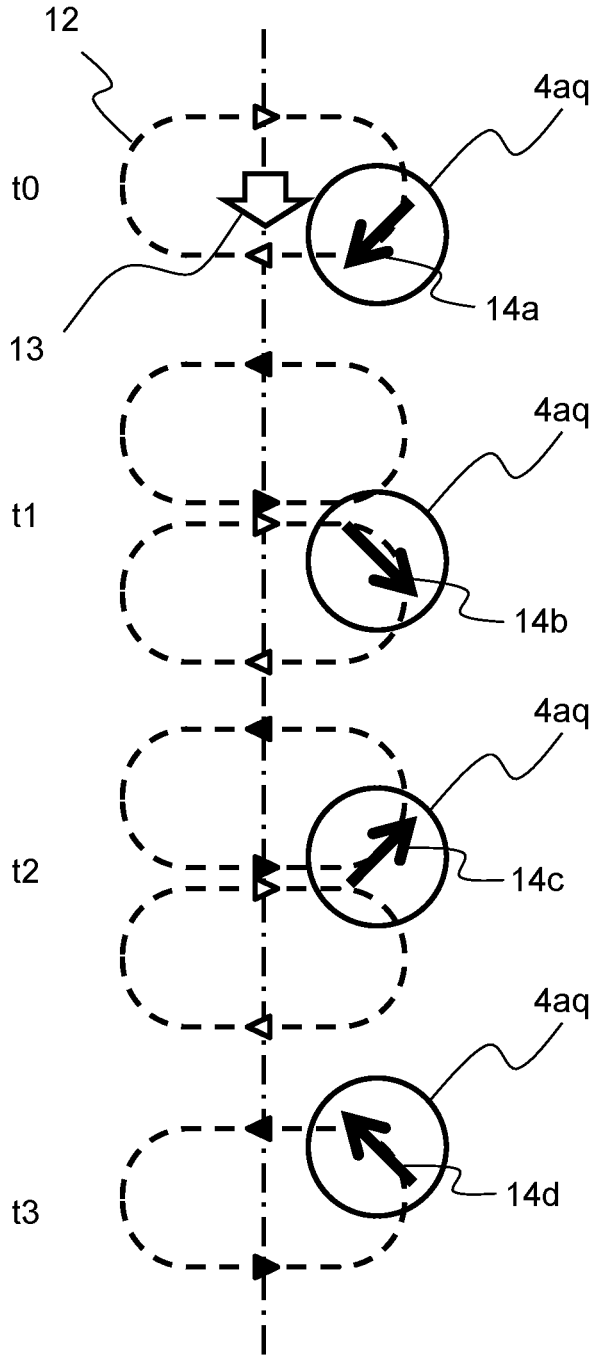
FIG. 9 shows changes in status of generating a circularly polarized wave in accordance with the sixth embodiment.

FIG. 9 shows changes in status of generating a circularly polarized wave at opening 4*aq* in accordance with the sixth embodiment.

Figure 13A:
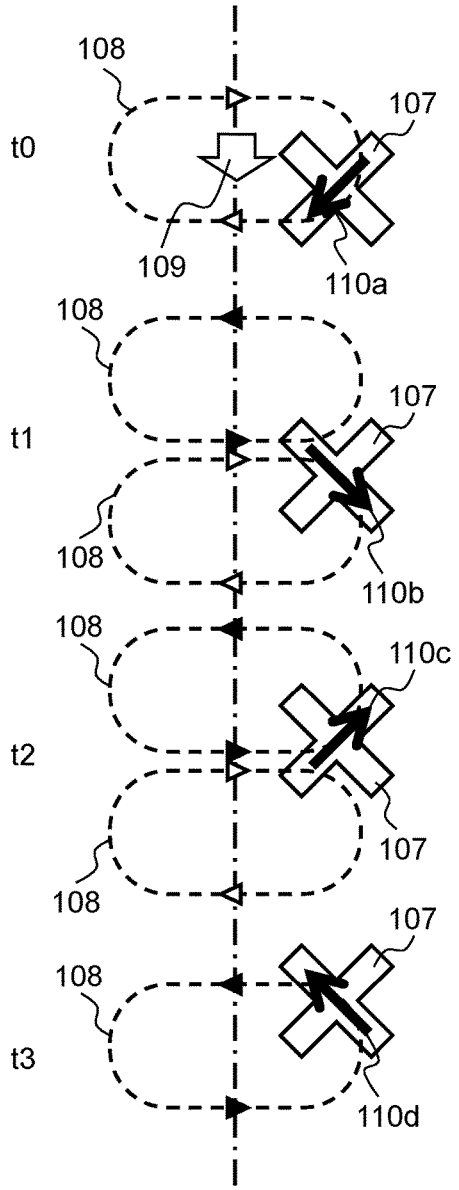
FIG. 13A shows a change in status in which a circularly polarized wave is generated at a cross-slot shaped opening.
Figure 13B:
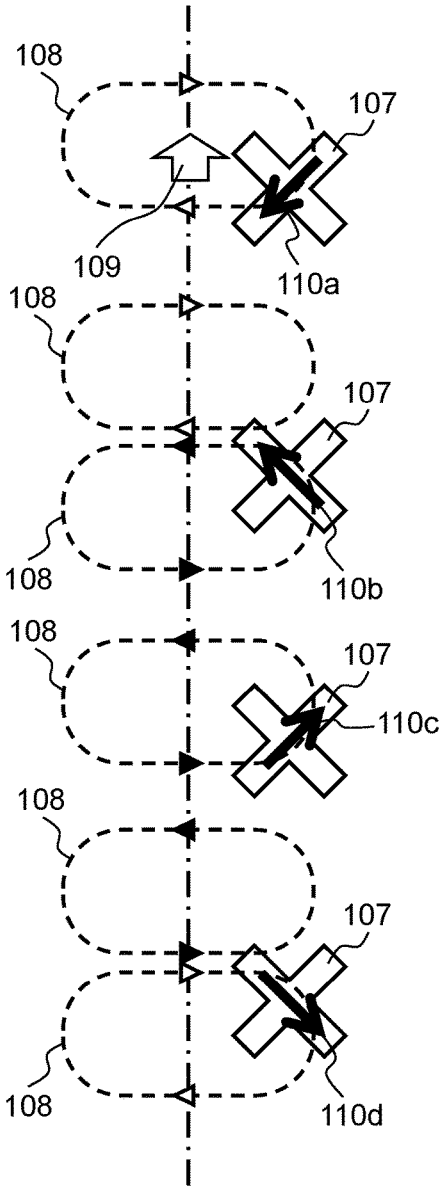
FIG. 13B shows a change in status in which the circularly polarized wave is generated at the cross-slot shaped opening.
Figure 14:
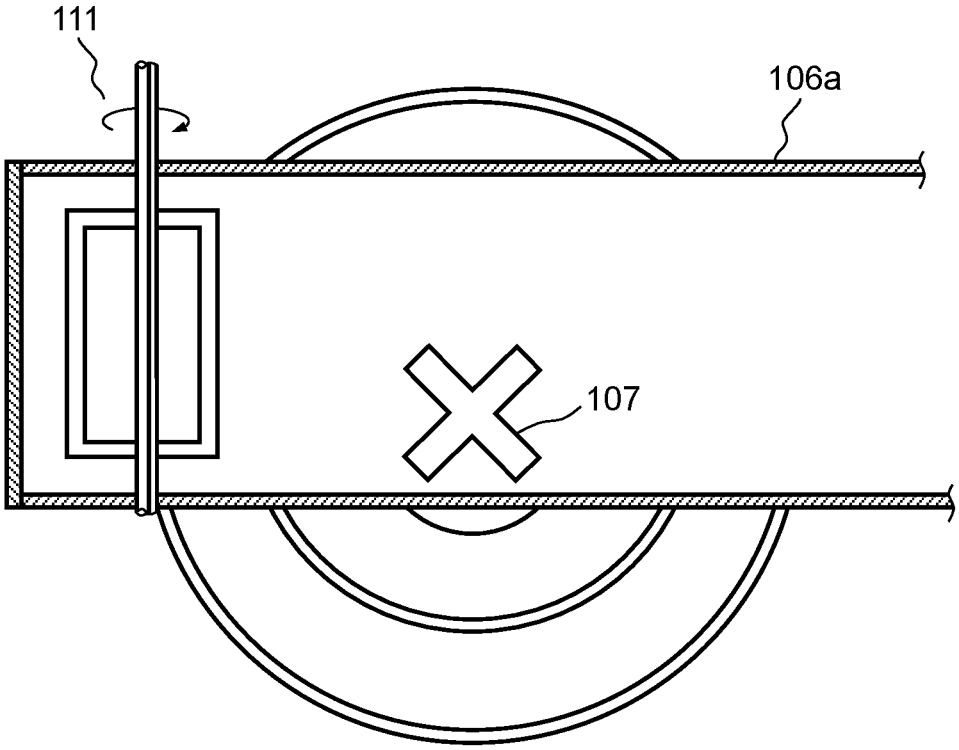
FIG. 14 is a schematic plan view of a waveguide that generates a circularly polarized wave in the conventional microwave treatment apparatus.
Figure 15:
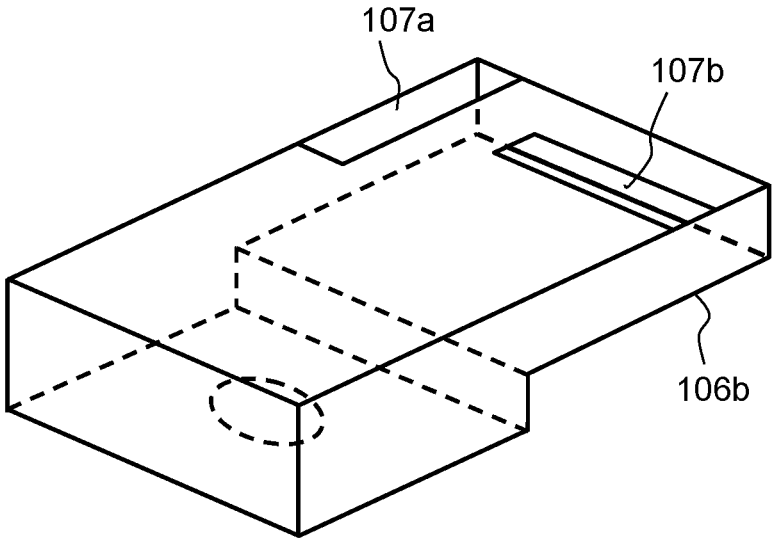
FIG. 15 is a schematic perspective view of the waveguide that generates a circularly polarized wave in the conventional microwave treatment apparatus.

In FIG. 9, similar to what is shown in FIG. 13A, the microwave propagates in downward direction 13 on the paper, and magnetic field 12 moves downward with the lapse of time.

As FIG. 9 shows, at time to, the microwave radiated from circularly-polarized-wave opening 4*aq* is excited by magnetic field 12 in exciting direction 14*a*. In a given time from time t0 (i.e. at time t1), magnetic field 12 travels through waveguide 3 (downward in FIG. 9), so that the microwave radiated from opening 4*aq* is excited in exciting direction 14*b*.

In a given time from time t1 (i.e. at time t2), the microwave radiated from opening 4*aq* is excited in exciting direction 14*c*, and in a given time from time t2 (i.e. at time t3), the microwave radiated from opening 4*aq* is excited in exciting direction 14*d*. The circularly polarized wave rotating anticlockwise is thus generated.

As discussed above, the microwave radiated from opening 4*aq* is excited at the edge of magnetic field 12 in waveguide 3, thereby changing the exciting direction with the lapse of time. The microwave supplied into heating chamber 1 is thus excited in two directions uniformly. As a result, the circularly polarized wave can be generated more positively.

Figure 8B:
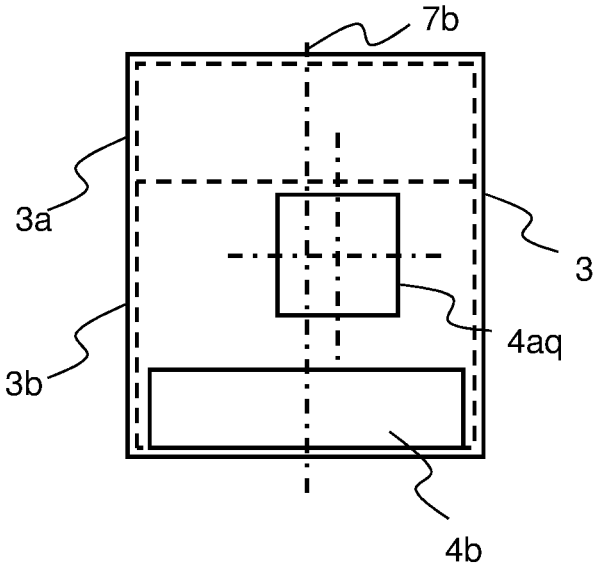
FIG. 8B shows an opening that allows a waveguide to communicate with a heating chamber in accordance with the sixth embodiment of the present disclosure.

In this sixth embodiment, opening 4*aq* in circular shape is demonstrated; however, the shape thereof is not limited to a circle. For instance, opening 4*aq* can form a square as shown in FIG. 8B, or regular polygon such as a regular pentagon or a regular hexagon. These instances can also obtain an advantage similar to what is discussed previously.

Seventh Exemplary Embodiment

Figure 10:
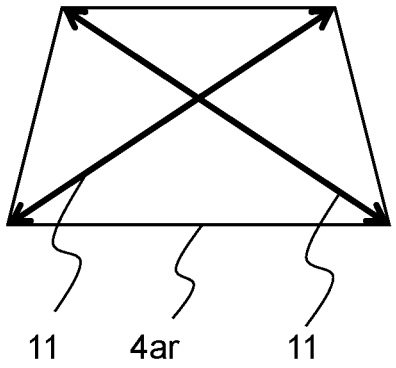
FIG. 10 shows an opening that allows a waveguide to communicate with a heating chamber in accordance with a seventh embodiment of the present disclosure.

FIG. 10 shows an example of an opening that allows waveguide 3 to communicate with heating chamber 1 of microwave oven 20 in accordance with the seventh embodiment.

As FIG. 10 shows, circularly-polarized-wave opening 4*ar* shapes like a trapezoid and has the maximum inner diameter at two places (i.e. a length of a diagonal line is maximum inner diameter 11).

The foregoing structure allows generating excitations in two directions different from each other more positively, so that a circularly polarized wave can be generated from opening 4*ar*.

Eighth Exemplary Embodiment

Figure 11A:
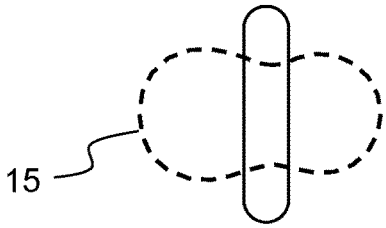
FIG. 11A shows a directivity of a slot opening provided to a waveguide.

FIG. 11A illustrates a directivity of a slot opening formed in waveguide 3.

As shown in FIG. 11A, the radiation directivity of the microwave radiated from the slot opening shows a distribution spreading in a direction orthogonally intersecting with a longer side of the slot opening. This distribution does not spread uniformly in two directions orthogonally intersecting with the longer side of the slot opening, but it spreads unevenly depending on a position, orientation, and so on of the slot opening formed in the wide plane of waveguide 3.

Figure 11B:
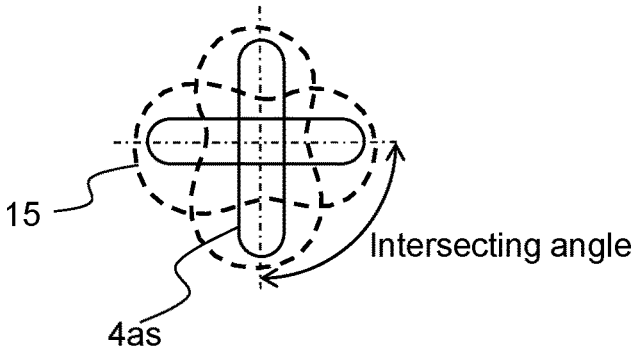
FIG. 11B shows a directivity of a circularly-polarized-wave opening provided to a waveguide in accordance with an eighth embodiment of the present disclosure.
Figure 11C:
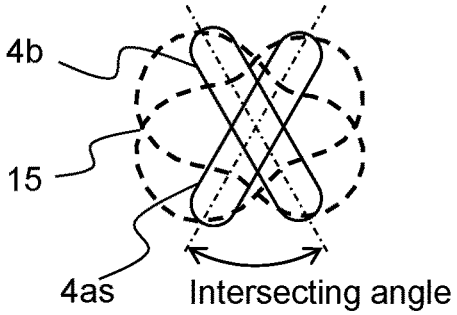
FIG. 11C shows a directivity of a circularly-polarized-wave opening provided to a waveguide in accordance with the eighth embodiment of the present disclosure.
Figure 12:
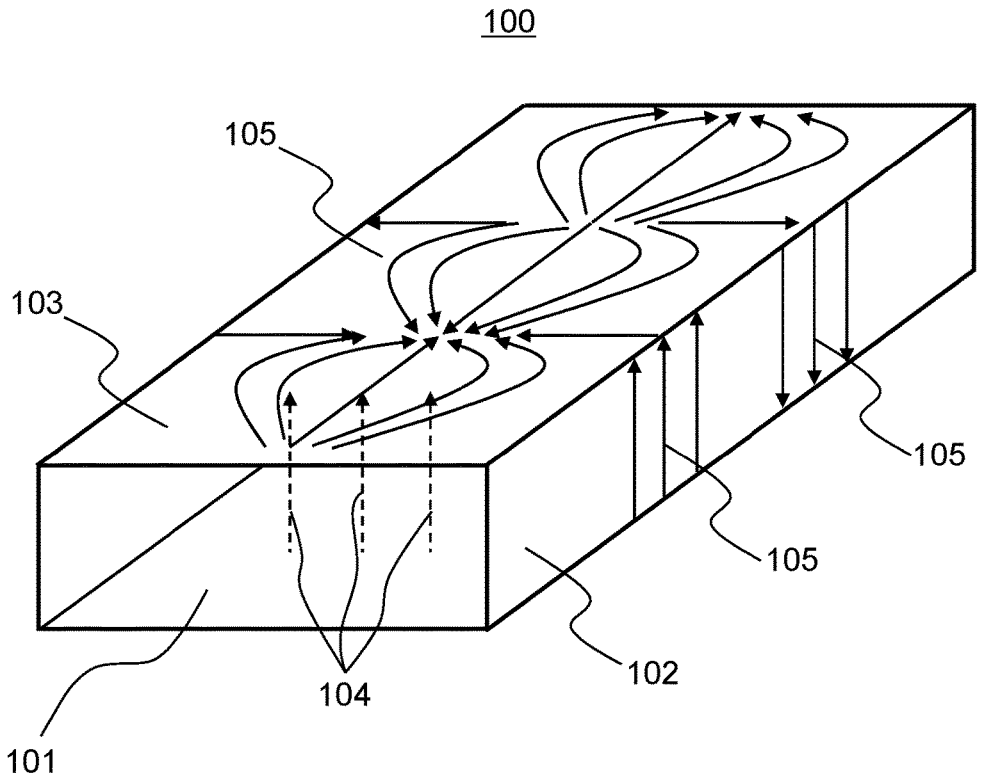
FIG. 12 shows electric currents flowing on a lateral face of a waveguide of a conventional microwave treatment apparatus.

FIG. 11B and FIG. 11C illustrates an example of a directivity of circularly-polarized-wave opening 4*as* formed on waveguide 3 in accordance with the eighth embodiment.

As FIG. 11B shows, in the case of opening 4*as* having a shape of a cross slot (i.e. two slot-openings intersect with each other at right angles), radiation directivity 15 can be distributed such that a strong directivity portion of one slot opening can compensate for a weak directivity portion of the other slot opening. This structure allows opening 4*as* to radiate the microwave in various directions more uniformly.

As FIG. 11C shows, in the case of opening 4*as* having a shape of a cross slot (i.e. two slot openings intersect with each other at angles other than 90 degrees), radiation directivity 15 is distributed unevenly. Appropriate selections of an intersecting angle of two slot-openings, and an intersecting angle of each of two slot-openings with tube axis 7*b* allow adjusting the electromagnetic field distribution with an aid of unevenness in radiation directivity 15 of the microwave.

INDUSTRIAL APPLICABILITY

The microwave treatment apparatus of the present disclosure allows irradiating a target object with a microwave uniformly. The microwave treatment apparatus thus can be applicable to microwave heating devices to be used for cooking and sterilization.

REFERENCE MARKS IN THE DRAWINGS

1 heating chamber
2 magnetron
3, 100, 106*a*, 106*b* waveguide
3*a* vertical section
3*b* parallel section
3*c* cross-section projected region
4, 4*a*, 4*aa*, 4*ab*, 4*ac*, 4*ad*, 4*ae*, 4*af*, 4*ag*, 4*ah*, 4*ai*, 4*aj*, 4*ak*, 4*al*, 4*am*, 4*an*, 4*ao*, 4*ap*, 4*aq*, 4*ar*, 4*as* circularly-polarized-wave opening
4*b*, 4*ba*, 4*bb*, 4*bc*, 4*bd*, 4*be*, 4*bf*, 4*bg* reflected-wave-suppression opening
5 table
6 target object
7*a*, 7*b* tube axis
8 traveling wave
9 reflected wave
10 standing wave
11 maximum inner diameter
12, 108 magnetic field
13, 109 propagating direction
14*a*, 14*b*, 14*c*, 14*d*, 110*a*, 110*b*, 110*c* exciting direction
15 radiation directivity
16*a*, 16*b* slot
20 microwave oven

The invention claimed is:

1. A microwave treatment apparatus comprising:

a heating chamber for accommodating a target object;

a microwave generator for generating a microwave; and a waveguide having an E-bend structure and including a first section for propagating the microwave from the microwave generator toward the heating chamber and a second section of which a wide plane abuts on an outer wall of the heating chamber;

wherein the heating chamber has a lateral face having a plurality of openings allowing the heating chamber to communicate with the waveguide, and including at least one circularly-polarized-wave opening for generating a circularly polarized wave and a second opening having a shape that differs from the at least one circularly-polarized-wave opening, and the circularly-polarized-wave opening is configured such that a cross section of the first section intersecting orthogonally with a tube axis of the first section is virtually projected along the tube axis of the first section onto the lateral face of the heating chamber, and a center of the circularly-polarized-wave opening is located outside a resultant cross-section-projected region defined by the projection.

2. The microwave treatment apparatus according to claim 1, wherein the second opening of the plurality of openings comprises a reflected-wave-suppression opening closer to an end of the waveguide than the circularly-polarized-wave opening, and having a length equal to or greater than a half of a wavelength of the microwave.

3. The microwave treatment apparatus according to claim 2 further comprising a table in a lower section of the heating chamber supporting the target object, and a driver for rotating the table, wherein the reflected-wave-suppression opening is in the lower section of the heating chamber.

4. The microwave treatment apparatus according to claim 1, wherein the circularly-polarized-wave opening comprises a combination of two slot-openings.

5. The microwave treatment apparatus according to claim 4, wherein the two slot-openings have a longer side having a length that is different from a length of a shorter side of the two slot-openings, and have rounded corners, and wherein the circularly-polarized-wave opening has a plurality of longest inner diameters.

6. The microwave treatment apparatus according to claim 4, wherein the two slot-openings intersect with each other at an angle other than 90 degrees.

7. The microwave treatment apparatus according to claim 4, wherein one of the two slot-openings intersects with a tube axis of the second section at a first angle, and another one of the two slot-openings intersects with the tube axis of the second section at a second angle different from the first angle.

8. The microwave treatment apparatus according to claim 1, wherein the center of the circularly-polarized-wave opening is located away from a tube axis of the second section.

9. The microwave treatment apparatus according to claim 1, wherein the circularly-polarized-wave opening has a shape of a regular polygon or a circle.

10. The microwave treatment apparatus according to claim 1, wherein the circularly-polarized-wave opening defines a polygonal opening, and the polygonal opening has a plurality of longest diagonal lines.

* * * * *